US009309786B2

(12) United States Patent
Kashiwabara et al.

(10) Patent No.: US 9,309,786 B2
(45) **Date of Patent: *Apr. 12, 2016**

(54) VALVE OPERATING DEVICE OF ENGINE

(71) Applicant: Mazda Motor Corporation, Aki-gun, Hiroshima (JP)

(72) Inventors: Takashi Kashiwabara, Aki-gun (JP); Akihiro Noda, Hatsukaichi (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/184,346

(22) Filed: Feb. 19, 2014

(65) Prior Publication Data

US 2014/0238326 A1 Aug. 28, 2014

(30) Foreign Application Priority Data

Feb. 26, 2013 (JP) ..... 2013-035745

(51) Int. Cl.
*F01L 1/34* (2006.01)
*F01L 1/047* (2006.01)
*F01L 13/00* (2006.01)

(52) U.S. Cl.
CPC ..... *F01L 1/047* (2013.01); *F01L 13/0036* (2013.01); *F01L 2001/0473* (2013.01); *F01L 2013/0052* (2013.01); *F01L 2820/031* (2013.01)

(58) Field of Classification Search
CPC ..... F01L 1/047; F01L 13/0036; F01L 2001/0473; F01L 2013/0052
USPC ..... 123/90.16, 90.18, 90.6
See application file for complete search history.

(56) References Cited

U.S. PATENT DOCUMENTS 7,404,383 B2 * 7/2008 Elendt ..... 123/90.16
9,038,584 B2 * 5/2015 Kashiwabara et al. .... 123/90.16
2011/0226205 A1 9/2011 Kraus

FOREIGN PATENT DOCUMENTS

DE 102007037358 A1 2/2009
DE 102010011897 A1 9/2011

OTHER PUBLICATIONS

German Patent and Trademark Office, Office Action Issued in German Patent Application No. 102014002267.6, Oct. 30, 2015, 13 pages.

* cited by examiner

*Primary Examiner* — Ching Chang
(74) *Attorney, Agent, or Firm* — Alleman Hall McCoy Russell & Tuttle LLP

(57) ABSTRACT

A valve operating device for an engine is provided. The device includes at least two cam elements per one shaft. End face cams are formed in opposing end faces of two adjacent cam elements, and the end face cams respectively have protruding portions being formed offset in phase so that the protruding portions overlap in the axial directions when the two cam elements are close to each other. A control member is provided, the control member is projected to an actuated position at which the control member is projected to engage with the end face cams so as to separate the adjacent cam elements from each other when the cam elements are close to each other, and the control member is retreated to a non-actuated position at which the control member is retreated from the actuated position.

4 Claims, 10 Drawing Sheets

VALVE OPERATING DEVICE OF ENGINE

BACKGROUND

The present invention relates to a valve operating device for an engine of a vehicle, particularly a valve operating device which switches a cam for opening and closing a valve.

A type of valve operating device for an engine is known, which is provided with a plurality of cams having nose parts in different shapes for each valve, and for switching opening degrees and open and close timings of intake and exhaust valves by selecting the cam for opening and closing the valves from among the plurality of cams, according to an operating state of the engine.

For example, US2011/0226205A1 discloses such a valve operating device. The valve operating device includes a camshaft comprised of a shaft and a cylindrical cam element spline-fitted onto the shaft and slidable in axial directions along the shaft. For each valve, a plurality of cams, each having a nose part in a different shape, are provided adjacent to each other in the outer circumference of the cam element. The valve operating device switches the cam for opening and closing the valve by sliding the cam element in one of the axial directions.

In this case, in the valve operating device of US2011/0226205A1, an end face cam is formed in one end face of the cam element, and a control member is provided to be able to enter into and retreat from a position adjacent in the axial directions to the end face cam and push the cam element in one of the axial directions by engaging with the end face cam in the entry. The valve operating device switches the cam by actuating the control member with an actuator.

Meanwhile, in the valve operating device of US2011/0226205A1, in order to move the cam element on the shaft in both axial directions, an end face cam is formed in both end faces of the cam element and a control member is provided for each of the end face cams on each side. Therefore, two control members are required for one cam element, and the number of components increases.

Particularly, with multi-cylinder engines, when a cam element is provided for each cylinder on a shaft of a single camshaft, two control members need to be disposed within a space on the camshaft between two cylinders for respectively moving, in the axial directions, the cam element of the cylinder on one side and the cam element of the cylinder on the other side. Thus, the distance between the two cylinders increases to secure the space and, as a result, the size of the engine increases.

Moreover, among multi-cylinder engines, in the case of a four-valve DOHC engine provided with two intake valves and two exhaust valves for each cylinder, in order to secure a space on the camshaft to dispose two control members between two cylinders, a distance between at least two intake valves or two exhaust valves has to be reduced for each cylinder, and thus, an opening area of each of the intake and exhaust valves into a combustion chamber is limited.

Further, regardless of whether an engine is a single-cylinder engine or multi-cylinder engine, when two cam elements for intake and exhaust valves are provided at a single camshaft for each cylinder, two control members are disposed in a central section of the cylinder and, in this case, the distance between the two valves becomes long and, similarly to the case described above, an opening area of each of the intake and exhaust valves into a combustion chamber is limited.

SUMMARY

The present invention is made in view of the above situations and provides a valve operating device for an engine which has the following configurations.

According to one aspect of the invention, a valve operating device for an engine is provided. The device has a camshaft, the camshaft includes a shaft and a cam element fitted onto the shaft to be integrally rotatable with the shaft and movable in axial directions along the shaft, the cam element is provided with a plurality of adjacent cam parts having a common base circle for one valve and having nose parts with different shapes, and the cam part to open and close the valve is switchable by moving the cam element in the axial directions on the shaft. The valve operating device includes at least two cam elements per one shaft. End face cams are formed in opposing end faces of two adjacent cam elements, and the end face cams respectively have protruding portions being formed offset in phase so that the protruding portions overlap in the axial directions when the two cam elements are close to each other. A control member is provided, the control member is projected to an actuated position at which the control member is projected to engage with the end face cams so as to separate the two cam elements from each other when the cam elements are close to each other, and the control member is retreated to a non-actuated position at which the control member is retreated from the actuated position.

Second end face cams may be formed in the other end faces of the two adjacent cam elements. Second control members may be provided for the respective two cam elements. Each of the second control members may be projected to an actuated position at which the second control member is projected, in a state where the cam element is separated from the adjacent cam element, to engage with the second end face cam so as to move the cam element to be close to the adjacent cam element. Each of the second control members may be retreated to a non-actuated position at which the second control member is retreated from the actuated position.

Here, the phrase "cam part" includes a cam part having a nose part formed to have a shape matching that of the base circle (a cam part of which lift amount is zero). Moreover, the phrase "two adjacent cam elements" includes two adjacent cam elements each provided for each cylinder of a multi-cylinder engine, and two cam elements provided for two respective valves of one cylinder of a single-cylinder engine or a multi-cylinder engine.

Further, when three or more cam elements are provided at one camshaft, a plurality of sets of the "two adjacent cam elements" exist, and the above configurations may be applied to each set. In this case, each second end face cam and each second control member of one of the sets become one of the opposing end face cams of the two adjacent cam elements in the other set and the control member for engaging with the opposing end face cams, respectively.

The engine may be a multi-cylinder engine including a plurality of cylinders arranged in a line. The two cam elements may be respectively provided for two adjacent cylinders of the plurality of cylinders, and the control member may be arranged to be able to engage with the opposing end face cams of the two cam elements between the two cylinders.

Here, when the engine has three or more cylinders, a plurality of sets of the "two adjacent cylinders" exist, and the above configurations are applied to each set.

Second end face cams may be formed in end faces of the two cam elements on the respective far sides, the two cam elements being provided for the cylinders located at both ends in the cylinder row. Second control members may be provided for the respective two cam elements. Each of the second control members may be projected to an actuated position at which the second control member is projected, in a state where the cam element is separated from the adjacent cam element, to engage with the second end face cam so as to move the cam element to be close to the adjacent cam element. Each of the second control members may be retreated to a non-actuated position at which the second control member is retreated from the actuated position.

According to the above configurations, the following effects can be obtained.

First, the end face cams are formed in the opposing end faces of the two cam elements, two cam elements being fitted onto the shaft of the camshaft. With this configuration, the single control member which is projected to and retreated from the position between the opposing end face cams is provided, and the two cam elements are moved to be separated from each other by the single control member. Thus, compared to a conventional valve operating device in which two control members for engaging with the respective opposing end face cams are provided between the opposing faces of the two cam elements, the number of components is reduced and the space for arranging the control member can be reduced.

Moreover, both end face cams respectively have the protruding portions being formed offset in phase so that the protruding portions overlap in the axial directions when the adjacent cam elements are close to each other. Thus, the two cam elements can be arranged close to each other and a size of the camshaft in the axial directions can be reduced more.

Therefore, for example, with a multi-cylinder engine, the engine can be suppressed from increasing in size by narrowing a distance between cylinders, and with a four-valve DOHC engine provided with two intake valves and two exhaust valves for each cylinder, an opening area of each of the intake and exhaust ports into a combustion chamber can be sufficiently secured.

Moreover, regardless of whether an engine is a single-cylinder engine or a multi-cylinder engine, when two cam elements are provided for each cylinder on a single camshaft, the arrangement space for the control member in the central section of the cylinder can be reduced compared to that for the conventional valve operating device, and also in this case, the opening area of each of the intake and exhaust valves into the combustion chamber can be sufficiently secured.

Moreover, the second end face cams are formed in the other end faces of the two cam elements, and the second control members for moving the respective two cam elements to be close to each other by engaging with the second end face cams are provided. Thus, when the two cam elements are in a state of being moved to be separated from each other by the control member, the two cam elements can be moved to be close to each other by the second control members.

In this case, by using the second end face cam and the second control member which is projected to and retreated from the actuated position, for example, compared to when a control member is actuated in the axial directions to push the cam element, the space in the axial directions for arranging the control member can be reduced and an increase in total length of the engine can also be reduced.

Further, the effects described above also apply to single-cylinder engines and multi-cylinder engines.

DETAILED DESCRIPTION OF EMBODIMENTS

Hereinafter, one embodiment of the present invention is described by using a valve operating device for a four-cylinder, four-valve DOHC engine as an example.

Figure 1:
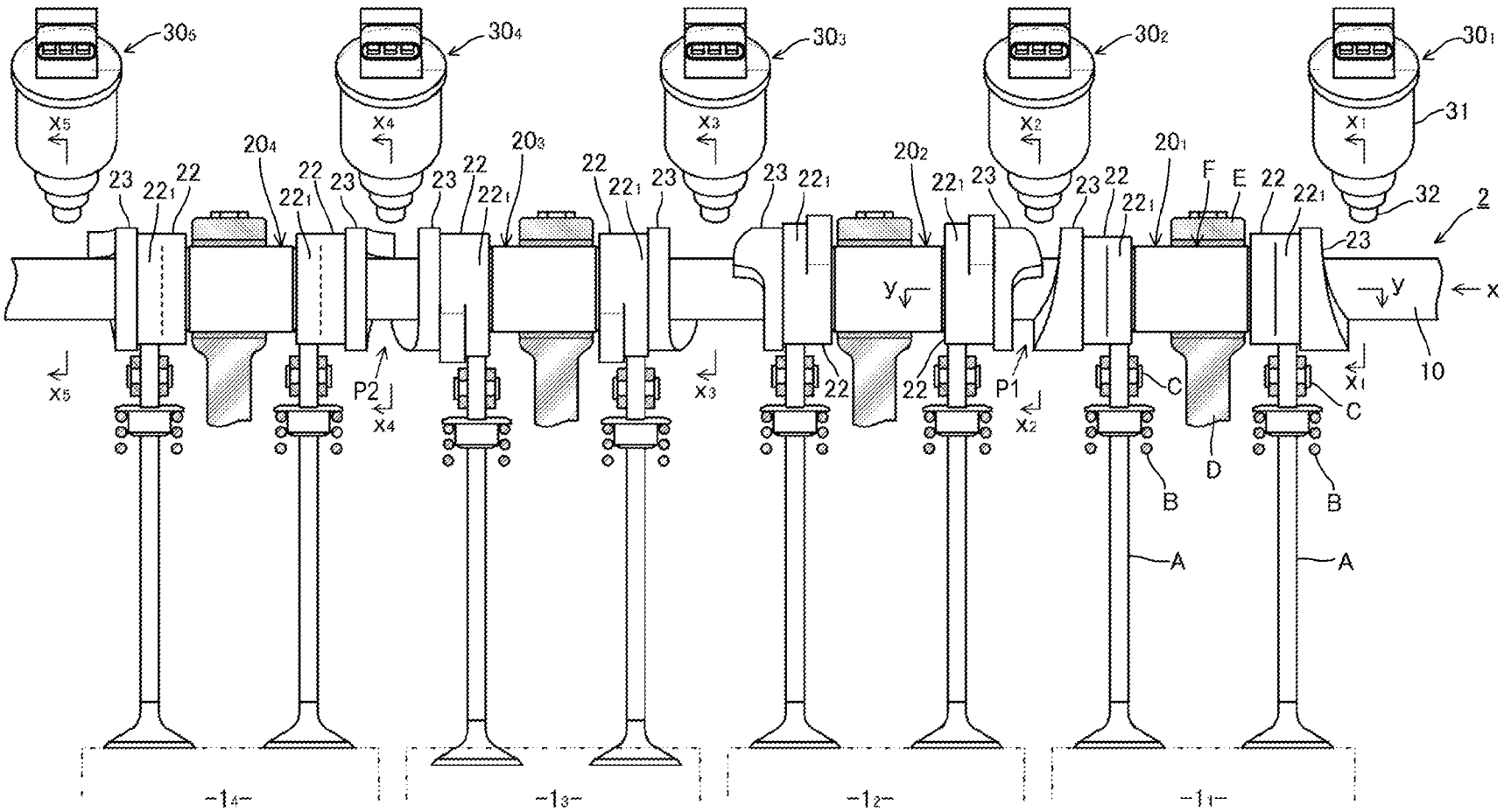
FIG. 1 is a side view schematically illustrating a configuration of an exhaust side valve operating device according to a first embodiment of the present invention.

FIG. 1 depicts a configuration of the valve operating device on an exhaust side according to this embodiment of the present invention. A cylinder head (not illustrated) includes two exhaust valves A for each of first to fourth cylinders $\mathbf{1}_1$ to $\mathbf{1}_4$ for a total of eight exhaust valves A, and return springs B for biasing the exhaust valves A in a closing direction. A camshaft 2 for opening the respective exhaust valves A against the biasing forces of the return springs B via rocker arms C is provided in an upper part of the cylinder head.

The camshaft 2 is rotatably supported by bearings F including vertical wall parts D provided at central positions of the respective cylinders $\mathbf{1}_1$ to $\mathbf{1}_4$ of the cylinder head, and cap members E attached on the respective vertical wall parts D. The camshaft 2 is rotatably driven by a crankshaft (not illustrated) via a chain.

Moreover, the camshaft 2 includes a shaft 10 and first to fourth cam elements $\mathbf{20}_1$ to $\mathbf{20}_4$ spline-fitted onto the shaft 10 and which integrally rotate with the shaft 10 and move in axial directions along the shaft. The cam elements $\mathbf{20}_1$ to $\mathbf{20}_4$ are arranged substantially in a line on the shaft 10 to correspond to the respective cylinders $\mathbf{1}_1$ to $\mathbf{1}_4$.

Further, five electromagnetic control devices $\mathbf{30}_1$ to $\mathbf{30}_5$ for moving the respective cam elements $\mathbf{20}_1$ to $\mathbf{20}_4$ on the shaft 10 by predetermined strokes are provided. When the first cylinder $\mathbf{1}_1$ is on the front side in the cylinder row, the first control device $30_1$ is disposed at a front end position of the cylinder row, the second control device $30_2$ is disposed at a position between the first and second cylinders, the third control device $30_3$ is disposed at a position between the second and third cylinders, the fourth control device $30_4$ is disposed at a position between the third and fourth cylinders, and the fifth control device $30_5$ is disposed at a rear end position of the cylinder row.

Figure 2:
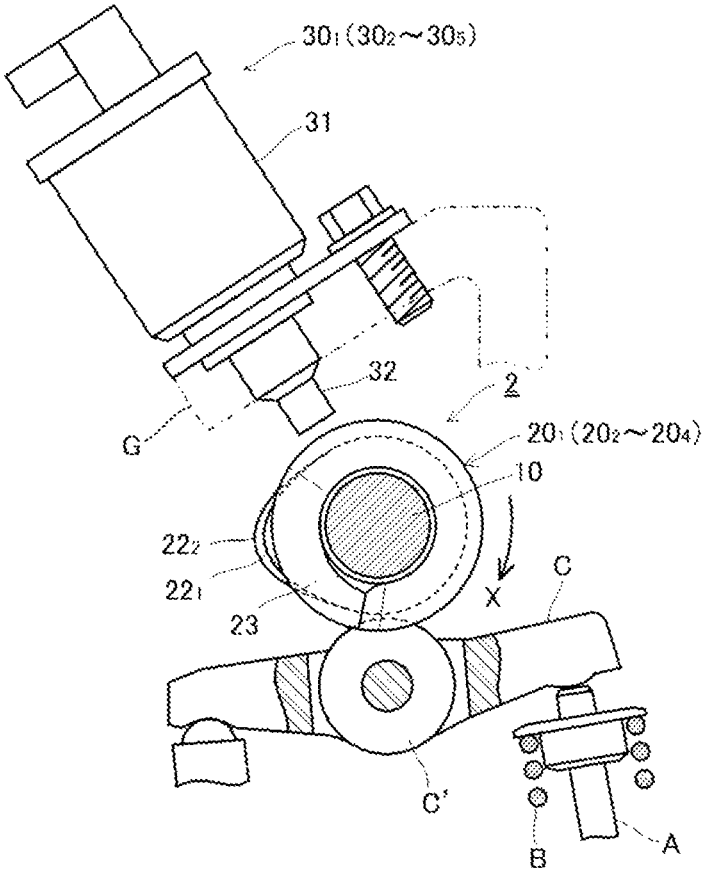
FIG. 2 is a plan view of the exhaust side valve operating device taken in an x-direction in FIG. 1.

Each of the control devices $30_1$ to $30_5$ includes a main body 31 and a pin part 32 serving as a control member for moving from a non-actuated position retracted into the main body 31 to an actuated position projecting from the main body 31 during power distribution thereto. As illustrated in FIG. 2, each of the control devices $30_1$ to $30_5$ is arranged at a predetermined angle (e.g., 30°) in a direction opposite a rotating direction X from a position opposite a cam follower C' of the rocker arm C with respect to the camshaft 2 therebetween, so that the pin part 32 is oriented toward an axial center of the camshaft 2. In this embodiment, each of the control devices $30_1$ to $30_5$ is attached to a pedestal G integrally formed with the cap member E constituting the bearing F.

Figure 3:
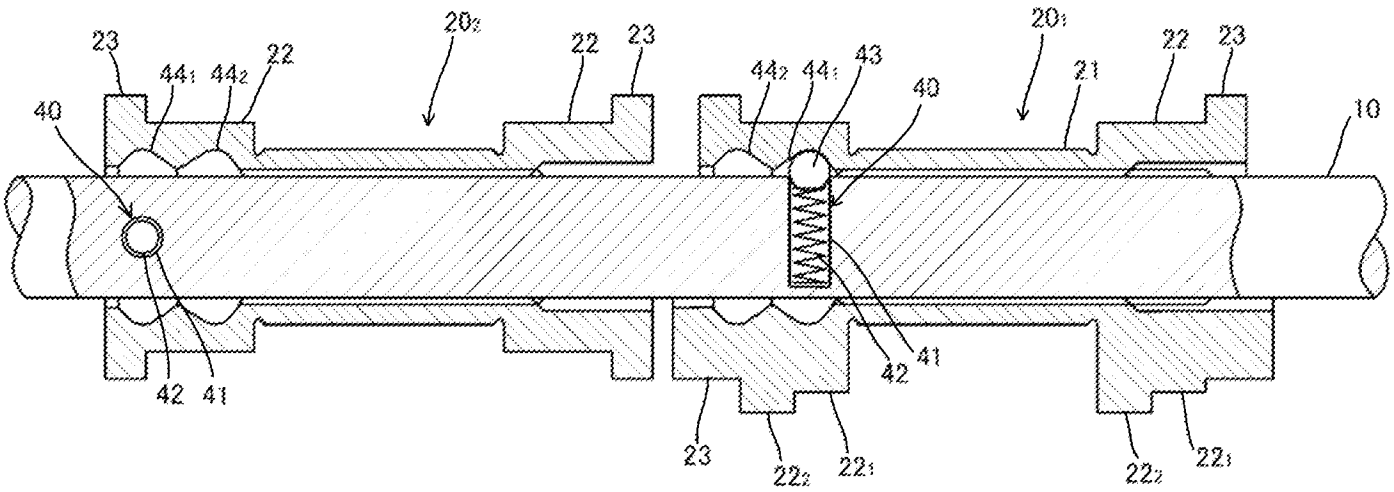
FIG. 3 is an enlarged cross-sectional view taken along a line y-y in FIG. 1.

Moreover, in order to define the movements in the axial directions of the respective cam elements $20_1$ to $20_4$ by the control devices $30_1$ to $30_5$ at two predetermined positions, detent mechanisms 40 are provided at fitted parts of the shaft 10 for the respective cam elements $20_1$ to $20_4$ as illustrated in FIG. 3 by taking the first and second cam elements $20_1$ and $20_2$ as examples.

Each detent mechanism 40 includes a hole 41 formed radially inward from the outer circumferential face of the shaft 10, a spring 42 accommodated in the hole 41, a detent ball 43 disposed at an opening of the hole 41 and biased by the spring 42 such as to eject radially outward from the outer circumferential face of the shaft 10, and two circumferential grooves $44_1$ and $44_2$ formed adjacent to each other in the axial directions in the inner circumferential face of the corresponding cam element ($20_1$ to $20_4$). When the detent ball 43 is engaged by one of the circumferential grooves ($44_1$ in this embodiment), the corresponding cam element ($20_1$ to $20_4$) is positioned at a first position illustrated in FIG. 1, and when the detent ball 43 is engaged by the other circumferential groove ($44_2$ in this embodiment), the corresponding cam element ($20_1$ to $20_4$) is positioned at a second position illustrated in FIG. 4.

Here, as illustrated in FIG. 1, when all of the first to fourth cam elements $20_1$ to $20_4$ are at the respective first positions, the first cam element $20_1$ is positioned at a rearward position, the second cam element $20_2$ is positioned at a forward position, the third cam element $20_3$ is positioned a rearward position, and the fourth cam element $20_4$ is positioned at a forward position. Therefore, opposing end faces of the first and second cam elements $20_1$ and $20_2$ are close to each other, opposing end faces of the second and third cam elements $20_2$ and $20_3$ are far from each other, and opposing end faces of the third and fourth cam elements $20_3$ and $20_4$ are close to each other.

Figure 4:
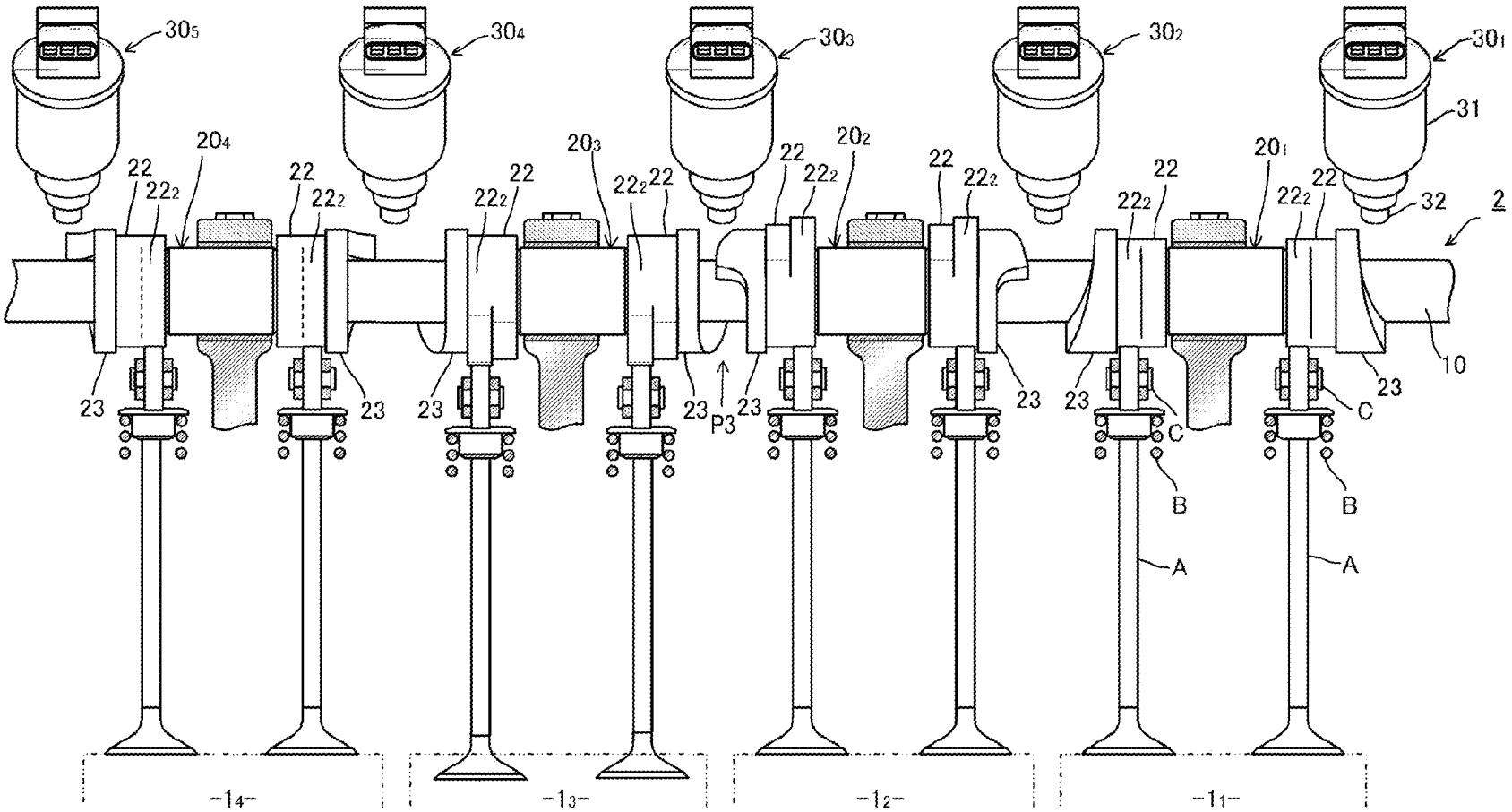
FIG. 4 is a side view illustrating the exhaust side valve operating device in a state where cam parts for opening and closing valves are switched from the state in FIG. 1.

Moreover, as illustrated in FIG. 4, when all of the first to fourth cam elements $20_1$ to $20_4$ are at the respective second positions, the first cam element $20_1$ is positioned forward, the second cam element $20_2$ is positioned rearward, the third cam element $20_3$ is positioned forward, and the fourth cam element $20_4$ is positioned rearward. Therefore, the opposing end faces of the first and second cam elements $20_1$ and $20_2$ are far from each other, the opposing end faces of the second and third cam elements $20_2$ and $20_3$ are close to each other, and the opposing end faces of the third and fourth cam elements $20_3$ and $20_4$ are far from each other.

Figure 5:
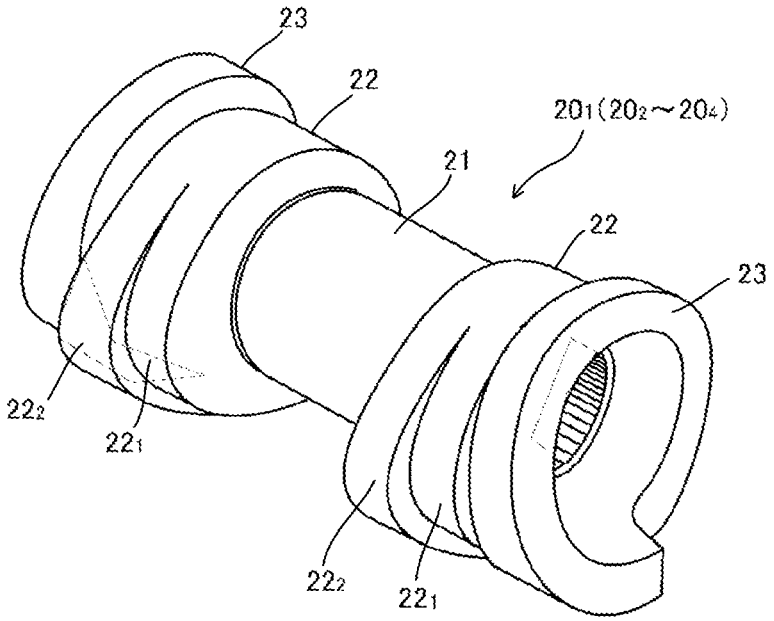
FIG. 5 is a single perspective view of a cam element.
Figure 6:
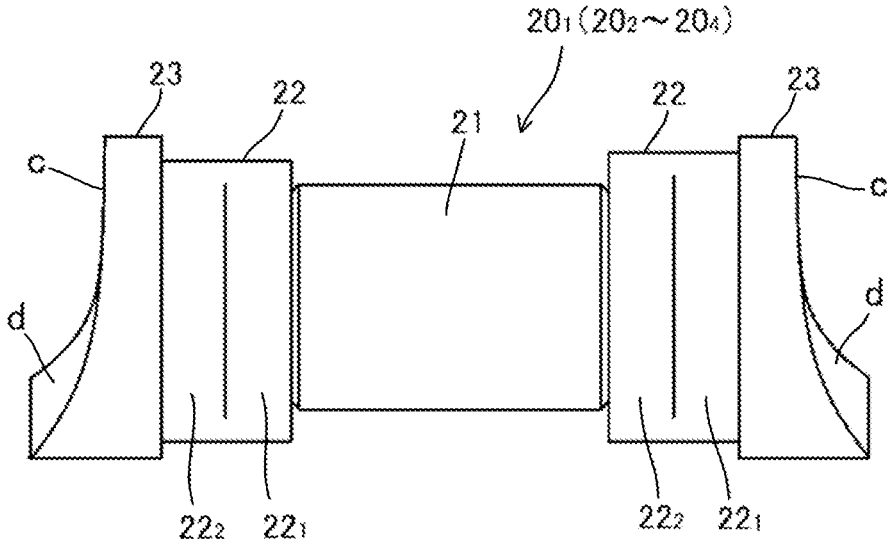
FIG. 6 is a side view of the cam element.
Figure 7:
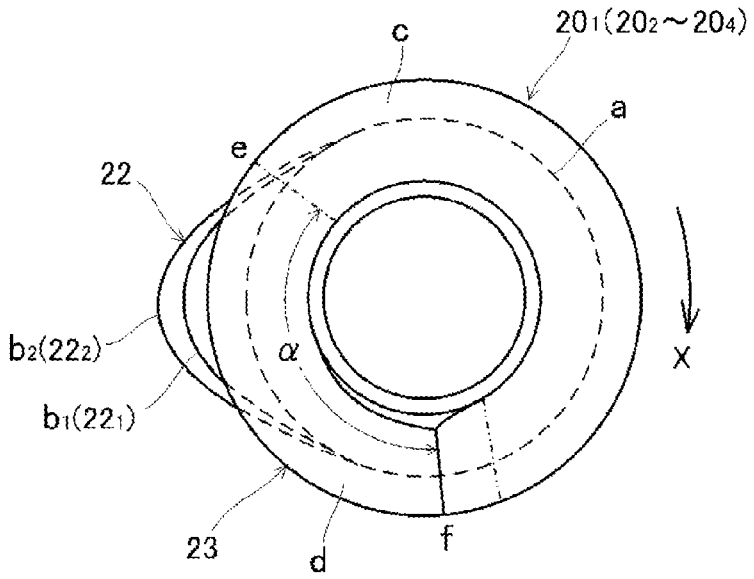
FIG. 7 is a plan view of the cam element.

Next, the configuration of the cam elements $20_1$ to $20_4$ is described in further detail by taking the first cam element $20_1$ as an example, with reference to FIGS. 5 to 7.

The first cam element $20_1$ ($20_2$ to $20_4$) is formed cylindrically. The outer circumferential face of an intermediate part thereof serves as a journal face 21 supported by the bearing part F, and operating parts 22 for the two respective exhaust valves A of the cylinder are provided on front and rear sides of the journal face 21, respectively. Each operating part 22 is provided with: a first cam part $22_1$ used for, for example, a low engine speed and having a low lift; and a second cam part $22_2$ used for, for example, a high engine speed and having a high lift. The first and second cam parts $22_1$ and $22_2$ are disposed adjacent to each other.

As illustrated in FIG. 7, the first and second cam parts $22_1$ and $22_2$ have a common base circle a and respective nose parts $b_1$ and $b_2$ with different lifts but matched phases on the base circle a. Further, the first and second cam parts $22_1$ and $22_2$ are provided such that the arrangement thereof in the front-and-rear directions and the phases of the nose parts $b_1$ and $b_2$ are uniform between the two operating parts 22.

In this case, as illustrated in FIGS. 1 and 4, in each of the first and third cam elements $20_1$ and $20_3$, the first cam part $22_1$ is disposed forward and the second cam part $22_2$ is disposed rearward, and in each of the second and fourth cam elements $20_2$ and $20_4$, the second cam part $22_2$ is disposed forward and the first cam part $22_1$ is disposed rearward.

Further, when the cam elements $20_1$ to $20_4$ are positioned at the respective first positions on the shaft 10 by the detent mechanisms 40, in each of the cam elements $20_1$ to $20_4$, the positions of the two first cam parts $22_1$ correspond to (are located right above) the two cam followers C' of the rocker arms C of the corresponding cylinder (see FIG. 1), and when the cam elements $20_1$ to $20_4$ are positioned at the respective second positions on the shaft 10, in each of the cam elements $20_1$ to $20_4$, the positions of the two second cam parts $22_2$ correspond to (are located right above) the two cam followers C' (see FIG. 4).

Here, in the engine of this embodiment, the combustion order of the cylinders is the first cylinder $1_1$, the third cylinder $1_3$, the fourth cylinder $1_4$, and then the second cylinder $1_2$. The first to fourth cam elements $20_1$ to $20_4$ are offset in phase and are spline-fitted onto the shaft 10, so that the positions of the nose parts $b_1$ of the first cam parts $22_1$ or the nose parts $b_2$ of the second cam parts $22_2$ of each of the respective cam elements $20_1$ to $20_4$ correspond to the cam followers C' in the combustion order every time the camshaft 2 rotates by 90°.

Further, each of the cam elements $20_1$ to $20_4$ is formed with end face cams 23 at its front and rear ends.

As illustrated in FIGS. 5 to 7, the end face cams 23 at both of the front and rear ends have protruding portions d protruding forward and rearward respectively in axial directions of the cam element $20_1$ ($20_2$ to $20_4$) from reference surfaces c symmetrically with respect to the cross section including the center of the cam element $20_1$ ($20_2$ to $20_4$) in the axial directions. As illustrated in FIG. 7, within a predetermined angle range a (e.g., 120°) from a protrusion start position e to a protrusion end position f, the amount that each protruding portion d protrudes from the reference surface c in the corresponding axial direction increases gradually in the rotating direction X and returns to zero (the protruding portion ends and returns to the reference surface c) at the protrusion end position f.

Moreover, since the cam elements $20_1$ to $20_4$ are spline-fitted onto the shaft 10 with predetermined phase differences from each other according to the combustion order of the respective cylinders $1_1$ to $1_4$ as described above, the opposing end face cams 23 of the respective cam elements $\mathbf{20}_1$ to $\mathbf{20}_4$ also have phase differences with each other. Thus, as indicated by "P1" and "P2" in FIG. 1 and "P3" in FIG. 4, when the adjacent cam elements are close to each other, the protruding portions d of the opposing end face cams 23 therebetween overlap with each other in the axial directions.

Further, in the state where the protruding portions d of the opposing end face cams 23 of the corresponding two cam elements overlap with each other, each of the pin parts 32 of the second to fourth control devices $\mathbf{30}_2$ to $\mathbf{30}_4$ are projected to the actuated position to engage with the opposing end face cams 23. Thus, the pin part 32 slides the two cam elements, which are close to each other, to separate them according to the rotation of the camshaft 2.

Here, in the state illustrated in FIG. 1, the first and second cam elements $\mathbf{20}_1$ and $\mathbf{20}_2$ move from the respective first positions to the respective second positions illustrated in FIG. 4 by being separated from each other, and the third and fourth cam elements $\mathbf{20}_3$ and $\mathbf{20}_4$ move from the respective first positions to the respective second positions illustrated in FIG. 4 by being separated from each other. Moreover, in the state illustrated in FIG. 4, the second and third cam elements $\mathbf{20}_2$ and $\mathbf{20}_3$ move from the respective second positions to the respective first positions illustrated in FIG. 1 by being separated from each other.

On the other hand, in the state where the first cam element $\mathbf{20}_1$ is at the second position which is the forward position as illustrated in FIG. 4, the pin part 32 of the first control device $\mathbf{30}_1$ is projected to the actuated position to engage with the front end face cam 23 of the first cam element $\mathbf{20}_1$. Thus, the pin part 32 of the control device $\mathbf{30}_1$ moves the first cam element $\mathbf{20}_1$ to the first position which is the rearward position, according to the rotation of the camshaft 2. Similarly, in the state where the fourth cam element $\mathbf{20}_4$ is at the second position which is the rearward position, the pin part 32 of the fifth control device $\mathbf{30}_5$ is projected to the actuated position to engage with the rear end face cam 23 of the fourth cam element $\mathbf{20}_4$. Thus, the pin part 32 of the fifth control device $\mathbf{30}_5$ moves the fourth cam element $\mathbf{20}_4$ to the first position which is the forward position.

Here, the pin parts 32 of the first and fifth control devices $\mathbf{30}_1$ and $\mathbf{30}_5$ need to be projected to the actuated positions at a time at which the reference surface c of the front end face cam 23 of the first cam element $\mathbf{20}_1$ is on the same side in a circumferential direction of the shaft as an oriented position (actuated position) of the corresponding pin part 32 and adjacent in the axial directions to the oriented position and a time at which the reference surface c of the rear end face cam 23 of the fourth cam element $\mathbf{20}_4$ is on the same side in the circumferential direction as an oriented position (actuated position) of the corresponding pin part 32 and adjacent in the axial directions to the oriented position, respectively. The pin parts 32 of the second to fourth control devices $\mathbf{30}_2$ to $\mathbf{30}_4$ need to be projected to the actuated positions at respective timings at which both reference surfaces c of the two opposing end face cams 23 are on the same side in the circumferential direction of the shaft as an oriented position (actuated position) of the corresponding pin part 32 and adjacent in the axial directions to the oriented position.

Moreover, each of the movements of the cam elements $\mathbf{20}_1$ to $\mathbf{20}_4$ by projecting the pin parts 32 to the actuated positions needs to be performed at a time at which the position of the cam follower C' of the rocker arm C corresponds to the base circle a of the first cam part $\mathbf{22}_1$ and a time at which the position of the cam follower C' of the rocker arm C corresponds to the base circle a of the second cam part $\mathbf{22}_2$, in other words, at a time at which the corresponding cylinder is not on an exhaust stroke.

Therefore, to satisfy the conditions of the operation timings, in this embodiment, as illustrated in FIG. 7, the protrusion start position e of the end face cam 23 is set to a position at a predetermined angle to the rotating direction X from the top of the nose parts $b_1$ and $b_2$ of the first and second cam parts $\mathbf{22}_1$ and $\mathbf{22}_2$, and the protrusion end position f of the end face cam 23 is set to a position at a predetermined angle from the top to the side opposite the rotating direction X. Thus, the nose parts $b_1$ and $b_2$ of the first and second cam parts $\mathbf{22}_1$ and $\mathbf{22}_2$ are in a positional relationship to the protruding portion d of the end face cam 23 such that they overlap with each other. In this case, based on the positional relationship of the cam follower C' of the rocker arm C with the pin parts 32 of the control devices $\mathbf{30}_1$ to $\mathbf{30}_5$ as illustrated in FIG. 2, the respective cam elements $\mathbf{20}_1$ to $\mathbf{20}_4$ move immediately after the exhaust stroke ends.

Next, the operation of this embodiment is described.

Firstly, as illustrated in FIG. 1, for example, when the engine is operated in low speed and the first to fourth cam elements $\mathbf{20}_1$ to $\mathbf{20}_4$ are positioned at the respective first positions, in each of the cam elements $\mathbf{20}_1$ to $\mathbf{20}_4$, the positions of the first cam parts $\mathbf{22}_1$ with the low lift in the operating parts 22 in both end sections correspond to the cam followers C' of the rocker arms C, and the exhaust valves A of each of the cylinders $\mathbf{1}_1$ to $\mathbf{1}_4$ open to a relatively small degree on the exhaust stroke in the combustion order, according to the rotation of the camshaft 2.

When switching from this state to a state where the opening degree of the exhaust valves A is larger due to, for example, an increase in engine speed, the switch operation is performed by distributing power to the second and fourth control devices $\mathbf{30}_2$ and $\mathbf{30}_4$ to project the pin parts 32 from the respective non-actuated positions to the respective actuated positions.

Figure 8A:
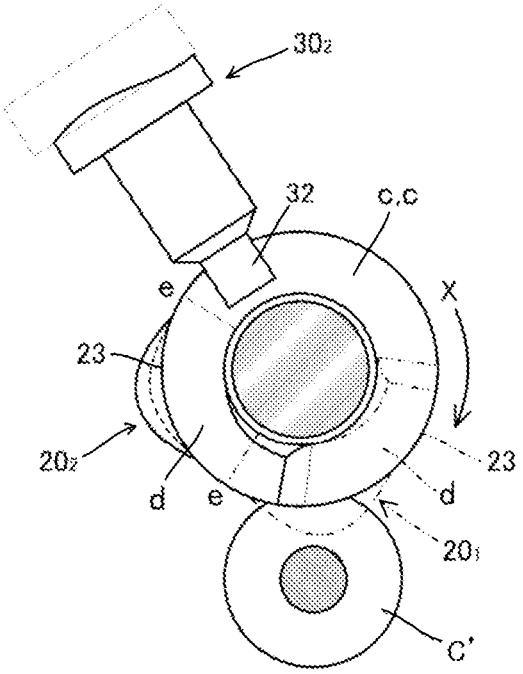
FIG. 8A is a plan view illustrating a main part in an operation for switching the cam part for opening and closing the valve from a first cam part into a second cam part, which is taken along a line $x_2$-$x_2$.

Specifically, first, the pin part 32 of the second control device $\mathbf{30}_2$ is projected to the position between the opposing end face cams 23 of the first and second cam elements $\mathbf{20}_1$ and $\mathbf{20}_2$ which are close to each other at the respective first positions, and the pin part 32 engages with the end face cams 23 of which protruding portions d overlap with each other in the axial directions. In this case, as illustrated in FIG. 8A, the pin part 32 is projected in a period in which the reference surfaces c of the first and second cam elements $\mathbf{20}_1$ and $\mathbf{20}_2$ where the protruding amounts of the opposing end face cams 23 thereof are both zero, are on the same side in the circumferential direction as the oriented positions and adjacent in the axial directions to the oriented positions.

Then, after the exhaust stroke of the second cylinder $\mathbf{1}_2$ ends, the protrusion start position e of the front end face cam 23 of the second cam element $\mathbf{20}_2$ indicated by the solid line reaches the position of the pin part 32 of the second control device $\mathbf{30}_2$, and then, the pin part 32 pushes the second cam element $\mathbf{20}_2$ rearward to reach the second position while sliding in contact with the protruding portion d of the end face cam 23 according to the rotation of the camshaft 2.

Moreover, after the protrusion start position e of the end face cam 23 of the second cam element $\mathbf{20}_2$ reaches the position of the pin part 32, the camshaft 2 rotates 90° and the exhaust stroke of the first cylinder $\mathbf{1}_1$ ends, and then, the protrusion start position e of the rear end face cam 23 of the first cam element $\mathbf{20}_1$ indicated by the dotted line reaches the position of the pin part 32. Thereafter, the pin part 32 pushes the first cam element $\mathbf{20}_1$ forward to reach the second position while sliding in contact with the protruding portion d of the end face cam 23 according to the rotation of the camshaft 2.

Figure 8B:
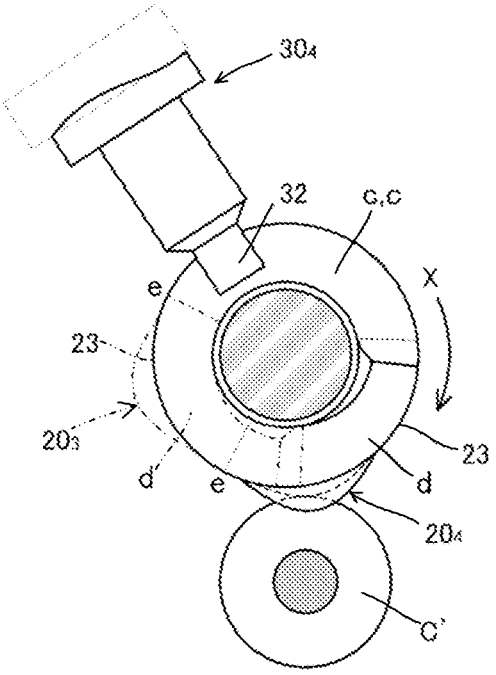
FIG. 8B is a plan view illustrating a main part in an operation for switching the cam part for opening and closing the valve from a first cam part into a second cam part, which is taken along a line $x_4$-$x_4$ in FIG. 1.

Next, as illustrated in FIG. 8B, the pin part 32 of the fourth control device $\mathbf{30}_4$ is projected to the position between the opposing end face cams 23 of the third and fourth cam elements $\mathbf{20}_3$ and $\mathbf{20}_4$ which are close to each other at the respective first positions, and the pin part 32 engages with the end face cams 23 of which protruding portions d overlap with each other in the axial directions. In this case, the pin part 32 is projected in a period in which the reference surfaces c of the third and fourth cam elements $\mathbf{20}_3$ and $\mathbf{20}_4$ where the protruding amounts of the opposing end face cams 23 thereof are both zero, are on the same side in the circumferential direction as the oriented positions and adjacent in the axial directions to the oriented positions.

Then, after the exhaust stroke of the third cylinder $\mathbf{1}_3$ ends, the protrusion start position e of the rear end face cam 23 of the third cam element $\mathbf{20}_3$ indicated by the dotted line reaches the position of the pin part 32 of the fourth control device $\mathbf{30}_4$, and then, the pin part 32 pushes the third cam element $\mathbf{20}_3$ forward to reach the second position while sliding in contact with the protruding portion d of the end face cam 23 according to the rotation of the camshaft 2.

Moreover, after the protrusion start position e of the end face cam 23 of the third cam element $\mathbf{20}_3$ reaches the position of the pin part 32, the camshaft rotates 90° and the exhaust stroke of the fourth cylinder $\mathbf{1}_4$ ends, and then, the protrusion start position e of the front end face cam 23 of the fourth cam element $\mathbf{20}_4$ indicated by the solid line reaches the position of the pin part 32. Thereafter, the pin part 32 pushes the fourth cam element $\mathbf{20}_4$ rearward to reach the second position while sliding in contact with the protruding portion d of the end face cam 23 according to the rotation of the camshaft 2.

As described above, all the first to fourth cam elements $\mathbf{20}_1$ to $\mathbf{20}_4$ move from the respective first positions to the respective second positions, and as illustrated in FIG. 4, in all the first to fourth cam elements $\mathbf{20}_1$ to $\mathbf{20}_4$, the positions of the second cam parts $\mathbf{22}_2$ of the operating parts 22 in both end sections correspond to the cam followers C' of the rocker arms C, and the exhaust valves A of the respective cylinders $\mathbf{1}_1$ to $\mathbf{1}_4$ open to a relatively large degree on the exhaust stroke.

On the other hand, when switching from the state illustrated in FIG. 4 where the positions of the second cam parts $\mathbf{22}_2$ having high lift in the respective cam elements $\mathbf{20}_1$ to $\mathbf{20}_4$ correspond to the cam followers C' of the rocker arms C, to a state illustrated in FIG. 1 where the positions of the first cam parts $\mathbf{22}_1$ having low lift correspond to the cam followers C' due to, for example, a decrease in engine speed, the switch operation is performed by distributing power to the first, third, and fifth control devices $\mathbf{30}_1$, $\mathbf{30}_3$, and $\mathbf{30}_5$ to project the pin parts 32 thereof from the respective non-actuated positions to the respective actuated positions.

Figure 9A:
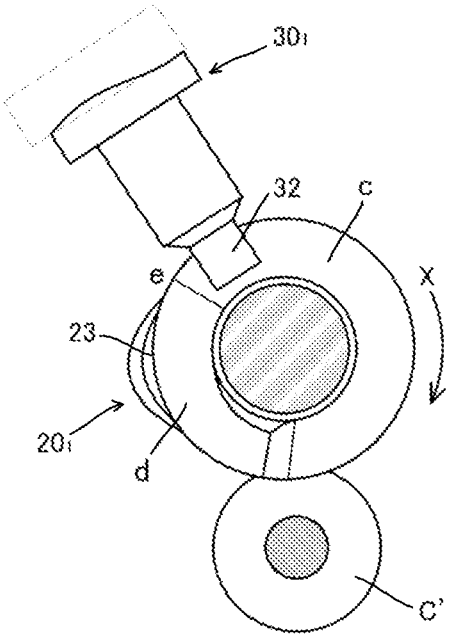
FIG. 9A is a plan view illustrating a main part in an operation for switching the cam part for opening and closing the valve from the second cam part into the first cam part, which is taken along a line $x_1$-$x_1$ in FIG. 1.

Specifically, first, as illustrated in FIG. 9A, in a period in which the reference surface c of this end face cam 23 is on the same side in the circumferential direction as the oriented position and adjacent in the axial directions to the oriented position, the pin part 32 of the first control device $\mathbf{30}_1$ is projected to a position adjacent in the axial directions to the front end face cam 23 of the first cam element $\mathbf{20}_1$ which is at the second position, to engage with the end face cam 23.

Then, after the exhaust stroke of the first cylinder $\mathbf{1}_1$ ends, the protrusion start position e of the front end face cam 23 of the first cam element $\mathbf{20}_1$ reaches the position of the pin part 32 of the first control device $\mathbf{30}_1$, and then, the pin part 32 pushes the first cam element $\mathbf{20}_1$ rearward to reach the first position while sliding in contact with the protruding portion d of the end face cam 23 according to the rotation of the camshaft 2.

Figure 9B:
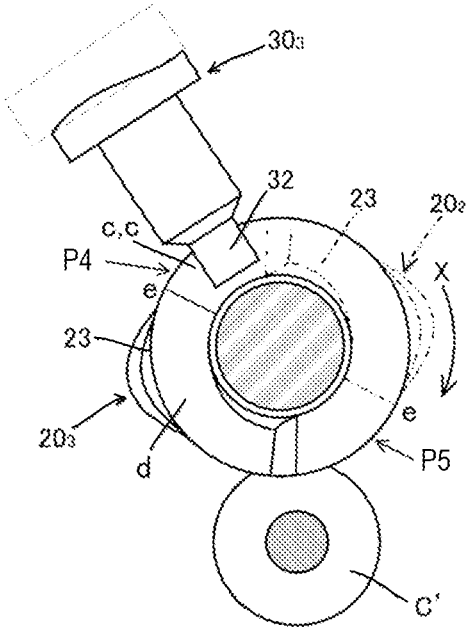
FIG. 9B is a plan view illustrating a main part in an operation for switching the cam part for opening and closing the valve from the second cam part into the first cam part, which is taken along a line $x_3$-$x_3$ in FIG. 1.

Moreover, when the camshaft 2 rotates 90° and the exhaust stroke of the third cylinder $\mathbf{1}_3$ ends after the protrusion start position e of the end face cam 23 of the first cam element $\mathbf{20}_1$ reaches the position of the pin part 32 of the first control device $\mathbf{30}_1$, as illustrated in FIG. 9B, the pin part 32 of the third control device $\mathbf{30}_3$ is projected to the position between the opposing end face cams 23 of the second and third cam elements $\mathbf{20}_2$ and $\mathbf{20}_3$ which are close to each other at the second positions, and the pin part 32 engages with the end face cams 23 of which protruding portions d overlap with each other.

In this case, although the pin part 32 of the third control device $\mathbf{30}_3$ is projected in a period in which the reference surfaces c of the second and third cam elements $\mathbf{20}_2$ and $\mathbf{20}_3$ where the protruding amounts of the opposing end face cams 23 thereof are both zero, are on the same side in the circumferential direction as the oriented positions and adjacent in the axial directions to the oriented positions, since the phase difference between the opposing end face cams 23 of the second and third cam elements $\mathbf{20}_2$ and $\mathbf{20}_3$ is 180°, as indicated by "P4" and "P5" in FIG. 9B, the period in which the oriented position of the pin part 32 corresponds to the reference surfaces c of both of the end face cams 23 is divided into two, and the period in which the pin part 32 can be projected becomes shorter.

Then, the protrusion start position e of the front end face cam 23 of the third cam element $\mathbf{20}_3$ indicated by the solid line first reaches the position of the pin part 32 of the third control device $\mathbf{30}_3$ projected to the position between both end face cams 23 in the period corresponding to "P4." Thereafter, the pin part 32 pushes the third cam element $\mathbf{20}_3$ rearward to reach the first position while sliding in contact with the protruding portion d of the end face cam 23 according to the rotation of the camshaft 2.

Figure 9C:
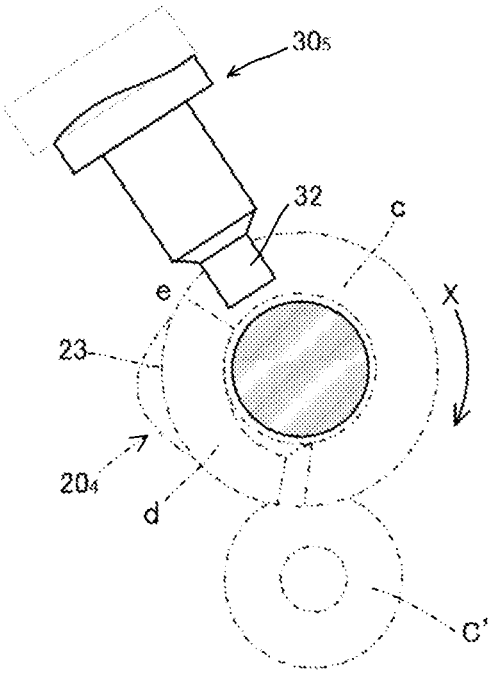
FIG. 9C is a plan view illustrating a main part in an operation for switching the cam part for opening and closing the valve from the second cam part into the first cam part, which is taken along a line $x_5$-$x_5$ in FIG. 1.

Further, substantially in parallel to the sliding of the third cam element $\mathbf{20}_3$, as illustrated in FIG. 9C, in a period in which the reference surface of this end face cam 23 is on the same side in the circumferential direction as the oriented position and adjacent in the axial directions to the oriented position, the pin part 32 of the fifth control device $\mathbf{30}_5$ is projected to the position adjacent in the axial directions to the rear end face cam 23 of the fourth cam element $\mathbf{20}_4$ which is at the second position, to engage with the end face cam 23.

Then, after the exhaust stroke of the fourth cylinder $\mathbf{1}_4$ ends, the protrusion start position e of the rear end face cam 23 of the fourth cam element $\mathbf{20}_4$ reaches the position of the pin part 32 of the fifth control device $\mathbf{30}_5$, and then, the pin part 32 pushes the fourth cam element $\mathbf{20}_4$ forward to reach the first position while sliding in contact with the protruding portion d of the end face cam 23 according to the rotation of the camshaft 2.

Figure 9D:
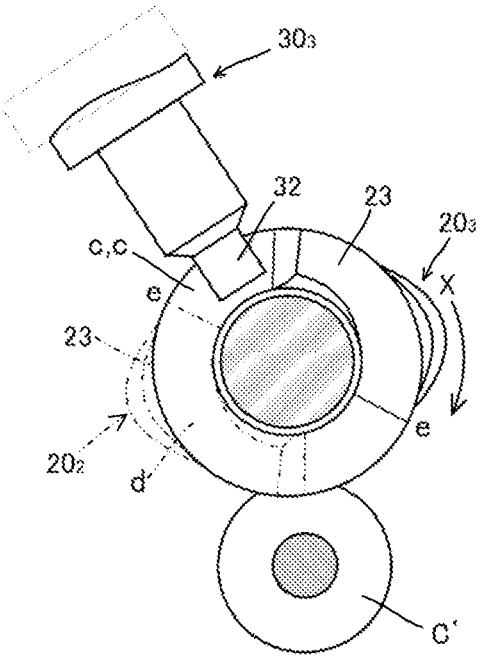
FIG. 9D is a plan view illustrating a main part in an operation for switching the cam part for opening and closing the valve from the second cam part into the first cam part, which is taken along the line $x_3$-$x_3$ in FIG. 1.

Further, in the state of FIG. 9B, after the protrusion start position e of the end face cam 23 of the third cam element $\mathbf{20}_3$ reaches the position of the pin part 32 of the third control device $\mathbf{30}_3$, the camshaft 2 rotates 180° and the exhaust stroke of the second cylinder $\mathbf{1}_2$ ends, and then, as illustrated in FIG. 9D, the protrusion start position e of the rear end face cam 23 of the second cam element $\mathbf{20}_2$ reaches the position of the pin part 32 of the third control device $\mathbf{30}_3$.

At this point, since the pin part 32 has already been projected to the position between the opposing end face cams 23 of the second and third cam elements $\mathbf{20}_2$ and $\mathbf{20}_3$, the pin part 32 pushes the second cam element $\mathbf{20}_2$ forward to reach the first position while sliding in contact with the protruding portion d of the end face cam 23 of the second cam element $\mathbf{20}_2$ according to the rotation of the camshaft 2.

Thus, all the first to fourth cam elements $\mathbf{20}_1$ to $\mathbf{20}_4$ move from the respective second positions to the respective first positions, and as illustrated in FIG. 1, the first cam parts $\mathbf{22}_1$ of the operating parts 22 in both end sections of all the first to fourth cam elements $\mathbf{20}_1$ to $\mathbf{20}_4$ return back to the state where the positions thereof correspond to the cam followers C' of the rocker arms C.

As described above, according to this embodiment, the four cam elements $\mathbf{20}_1$ to $\mathbf{20}_4$ provided at the respective four cylinders $\mathbf{1}_1$ to $\mathbf{1}_4$ are controlled by the five control devices $\mathbf{30}_1$ to $\mathbf{30}_5$, and each cam part for opening and closing the exhaust valve A is switched between the first cam part $\mathbf{22}_1$ with the low lift and the second cam part $\mathbf{22}_2$ with the high lift.

Therefore, compared to the case of providing two control devices for each cam element to switch the lift in the cam, the number of control devices is reduced, the distance between the cylinder is suppressed from increasing, and so is the size of the engine as a result. Moreover, free space is created between the two exhaust valves of each cylinder, and thus the opening area of the exhaust port to the combustion chamber can be increased.

Moreover, as described above, the protruding portions d of the opposing end face cams 23 overlap with each other in the axial directions when the adjacent cam elements are close to each other, as indicated by "P1" and "P2" in FIG. 1 and "P3" in FIG. 4. Therefore, each of the pin parts 32 of the second to fourth control devices $\mathbf{30}_2$ to $\mathbf{30}_4$ each engaging with the end face cams 23 can slide the two cam elements which are close to each other, in the directions of separating them from each other without enlarging the diameter of the pin part 32. Thus, the sizes of the pin parts 32 can be reduced and the operation responsiveness can be improved. Further, the layout of the first and second cam elements $\mathbf{20}_1$ and $\mathbf{20}_2$ and the layout of the third and fourth cam elements $\mathbf{20}_3$ and $\mathbf{20}_4$ may be such that they take up less space when the first and second cam elements $\mathbf{20}_1$ and $\mathbf{20}_2$ are close to each other and the third and fourth cam elements $\mathbf{20}_3$ and $\mathbf{20}_4$ are close to each other, which stimulates a further reduction in size of the camshaft 2 in the axial directions.

Moreover, although the above description has been given about the camshaft on the exhaust side, the camshaft on the intake side may be configured similarly or the same, and the same effects can be obtained on the intake side as well.

Figure 10:
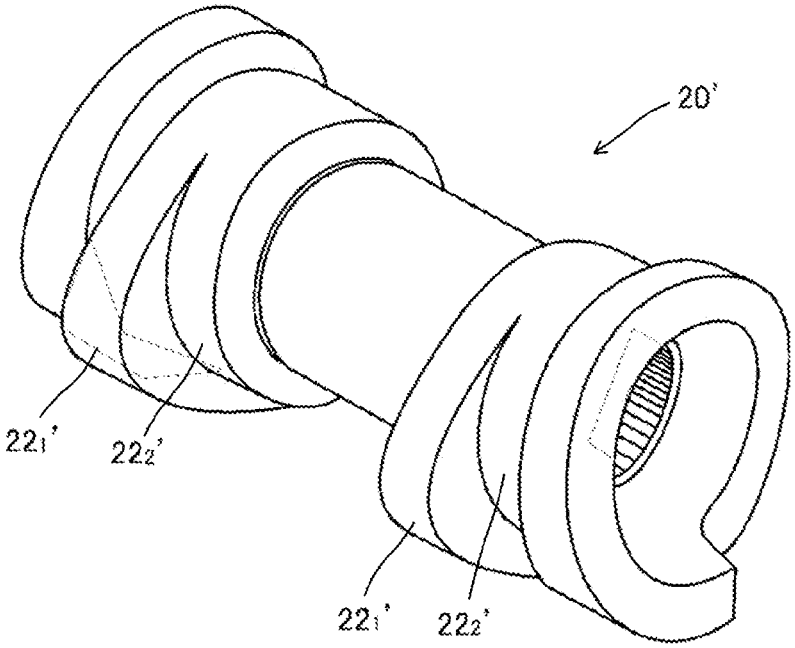
FIG. 10 is a single perspective view of a cam element in a modification of the first embodiment.

Moreover, in this embodiment, in all the cam elements $\mathbf{20}_1$ to $\mathbf{20}_4$, the lift in the first cam part $\mathbf{22}_1$ is set low and the lift in the second cam part $\mathbf{22}_2$ is set high; however, this may be the other way around. Further, it may be such that, as a cam element 20' is illustrated in FIG. 10, one cam part ($\mathbf{22}_1$' in this modification) is provided with a normal nose part but the other cam part $\mathbf{22}_2$' is formed entirely by just the base circle without a nose part (the lift in the nose part is zero), so that the valve is not opened and closed when the cam part $\mathbf{22}_2$' is used. According to this, a reduced-cylinder operation becomes available in an engine operation at, for example, a low engine load.

Further, in this embodiment, in all the cam elements $\mathbf{20}_1$ to $\mathbf{20}_4$, the two kinds of cam parts including the first cam part $\mathbf{22}_1$ with the low lift and the second cam part $\mathbf{22}_2$ with the high lift are provided; however, it is not limited to this, and the present invention is also applicable to a cam element including a plurality of cam parts. The cam element is configured such that a third cam part formed only by the base circle with no nose part and having no lift as described above is added in addition to the first and second cam parts $\mathbf{22}_1$ and $\mathbf{22}_2$, and the pin part of the control device is shaped to have a small diameter portion and a large diameter portion connected via a tapered portion and can slide the cam element at two levels. The switch operation of the cam part is performed such that the small diameter portion of the pin part is first projected to a position adjacent in the axial directions to the end face cam(s) for first level sliding (sliding by a relatively small amount), and then the large diameter portion of the pin part is projected thereto for second level sliding (sliding by a relatively large amount).

Further, the present invention is not limited to the four-cylinder, four-valve DOHC engine as described in this embodiment (hereinafter, referred to as the "first embodiment"), and is also applicable to various kinds of engines with different numbers of cylinders and valve operating types, such as inline six-cylinder engines and V-shaped, multi-cylinder engines. Next, other embodiments of the present invention are described. Note that in the following description, the configuration corresponding to the first embodiment is denoted with the same reference numeral. Further, although the exhaust side is described as an example, the configuration on the intake side is similar.

Figure 11:
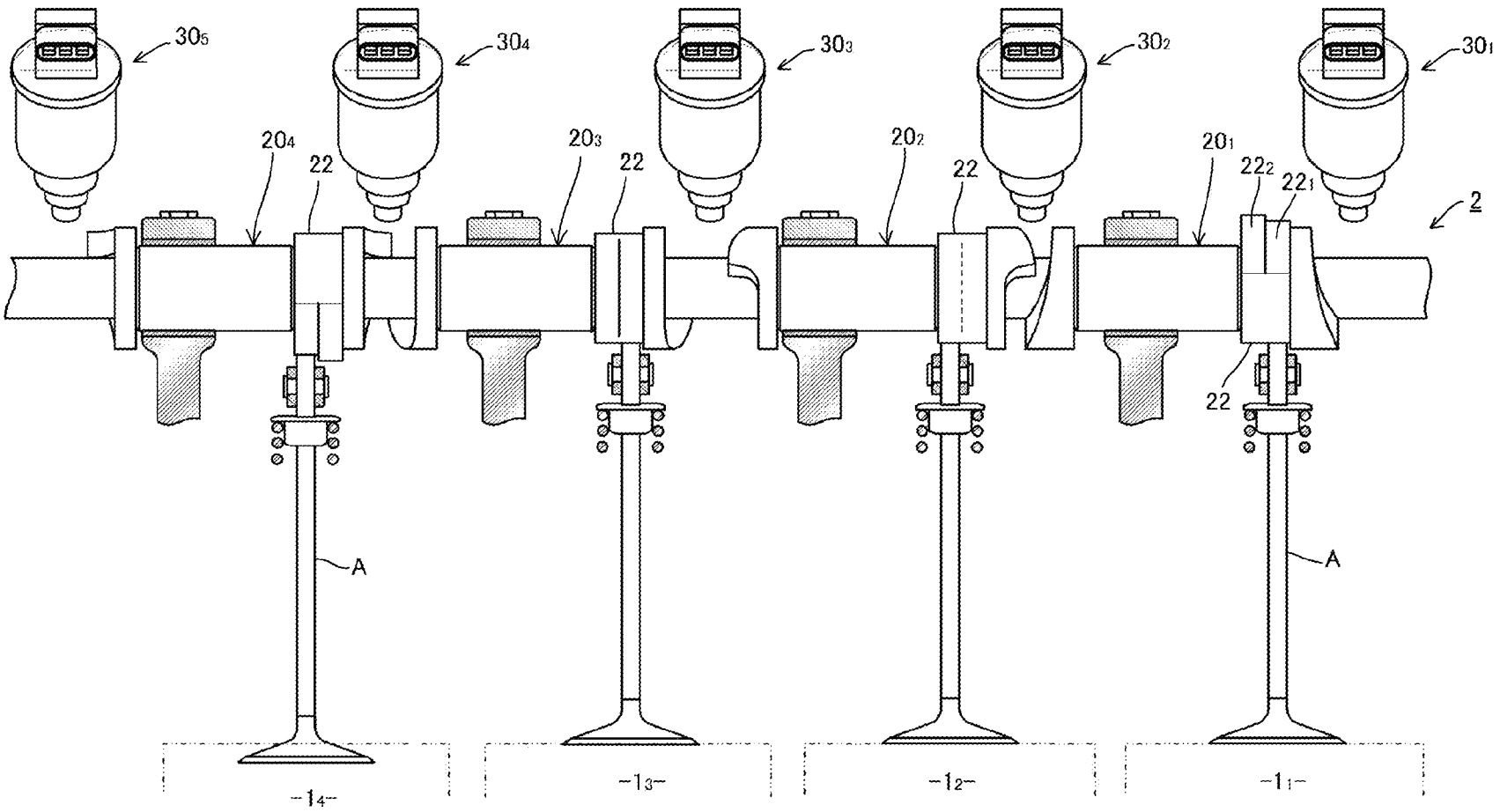
FIG. 11 is a side view schematically illustrating a configuration of an exhaust side valve operating device according to a second embodiment of the present invention.

In a second embodiment illustrated in FIG. 11, the present invention is applied to a four-cylinder, two-valve DOHC engine. In this embodiment, only one exhaust valve A is provided at each cylinder and, correspondingly, only one cam part 22 in which the first cam part $\mathbf{22}_1$ and the second cam part $\mathbf{22}_2$ are disposed adjacent to each other is provided at each of the cam elements $\mathbf{20}_1$ to $\mathbf{20}_4$ of the camshaft 2 and, except for this, other configuration is similar to the first embodiment.

Therefore, also in this embodiment, the four cam elements $\mathbf{20}_1$ to $\mathbf{20}_4$ are slid by the five control devices $\mathbf{30}_1$ to $\mathbf{30}_5$, and the cam part for opening and closing the exhaust valve A is switched between the first and second cam parts $\mathbf{22}_1$ and $\mathbf{22}_2$.

Figure 12:
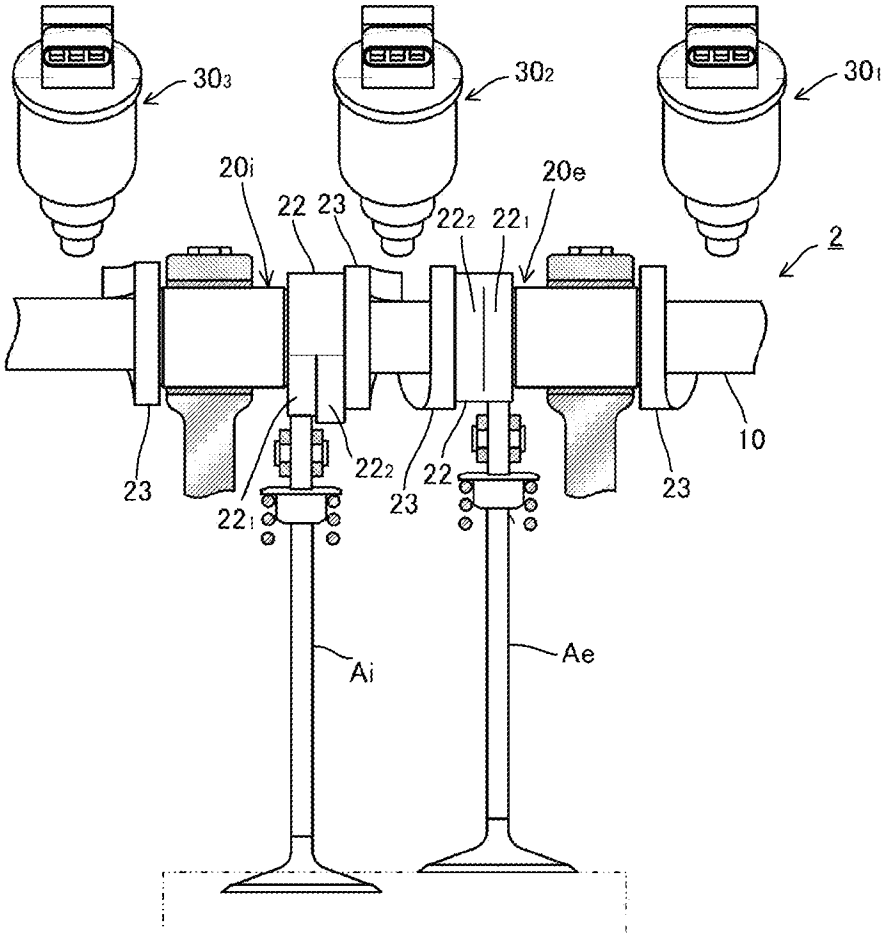
FIG. 12 is a side view schematically illustrating a configuration of an exhaust side valve operating device according to a third embodiment of the present invention.

Moreover, in a third embodiment illustrated in FIG. 12, the present invention is applied to a single-cylinder SOHC engine. In this embodiment, the shaft 10 constituting the camshaft 2 is fitted with a cam element **20*e* for an exhaust valve Ae and a cam element 20*i* for an intake valve Ai. A single cam part 22 in which first and second cam parts $\mathbf{22}_1$ and $\mathbf{22}_2$ are disposed adjacent to each other, and both end face cams 23, are provided at each of the cam elements 20*e* and 20*i***.

Moreover, first to third control devices $\mathbf{30}_1$ to $\mathbf{30}_3$ are disposed forward of the exhaust valve cam element **20*e*, between the exhaust valve cam element 20*e* and the intake valve cam element 20*i*, and rearward of the intake valve cam element 20*i***, respectively.

Further, as the pin part 32 of the second control devices $\mathbf{30}_2$ is projected to a position between the opposing end face cams 23 of the exhaust valve cam element **20*e* and the intake valve cam element 20*i*, the cam elements 20*e* and 20*i*** are separated from each other and the cam parts thereof for opening and closing the respective exhaust valve Ae and the intake valve Ai are switched from the first cam parts $\mathbf{22}_1$ to the second cam parts $\mathbf{22}_2$.

Moreover, as the pin parts 32 of the first and third control devices $\mathbf{30}_1$ and $\mathbf{30}_3$ are projected in the state where the exhaust valve cam element **20*e* and the intake valve cam element 20*i* are separated from each other, the pin parts 32 respectively engage with the front end face cam 23 of the exhaust valve cam element 20*e* and the rear end face cam 23 of the intake valve cam element 20*i* to bring the cam elements 20*e* and 20*i*** close to each other. Thus, the cam parts for opening and closing the respective exhaust valve Ae and the intake valve Ai are switched from the second cam parts $\mathbf{22}_2$ to the first cam parts $\mathbf{22}_1$.

Note that the third embodiment is also applicable to multi-cylinder SOHC engines by disposing the control devices similarly to the first and second embodiments.

As described above, according to the present invention, with a valve operating device for an engine of, for example, a vehicle, reductions in the number of components and size of the engine can be achieved, and therefore, the present invention may suitably be adopted in a field of manufacturing industry of such kind of engines.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

2 Camshaft
10 Shaft
$20_1$ to $20_4$ Cam Element
$22_1$ First Cam Part
$22_2$ Second Cam Part
23 End Face Cam
32 Control Member (Pin Part)

What is claimed is:

1. A valve operating device for an engine having a camshaft, the camshaft including a shaft and a cam element fitted onto the shaft to be integrally rotatable with the shaft and movable in axial directions along the shaft, the cam element being provided with a plurality of adjacent cam parts having a common base circle for one valve and having nose parts with different shapes, the cam part to open and close the valve being switchable by moving the cam element in the axial directions on the shaft, the valve operating device comprising:

at least two cam elements per one shaft, wherein end face cams are formed in opposing end faces of two adjacent cam elements, and the end face cams respectively have protruding portions being formed offset in phase so that the protruding portions overlap in the axial directions when the two cam elements are close to each other, and wherein a control member is provided, the control member is projected to an actuated position at which the control member is projected to engage with the end face cams so as to separate the adjacent cam elements from each other when the cam elements are close to each other, and the control member is retreated to a non-actuated position at which the control member is retreated from the actuated position.

2. The device of claim 1, wherein second end face cams are formed in the other end faces of the two adjacent cam elements, and wherein second control members are provided for the respective two cam elements, each of the second control members is projected to an actuated position at which the second control member is projected, in a state where the cam element is separated from the adjacent cam element, to engage with the second end face cam so as to move the cam element to be close to the adjacent cam element, and each of the second control members is retreated to a non-actuated position at which the second control member is retreated from the actuated position.

3. The device of claim 1, wherein the engine includes a plurality of cylinders arranged in a line, the two cam elements are respectively provided for two adjacent cylinders of the plurality of cylinders, and the control member is arranged to be able to engage with the opposing end face cams of the two cam elements between the two cylinders.

4. The device of claim 3, wherein second end face cams are formed in end faces of the two cam elements on the respective far sides, the two cam elements being provided for the cylinders located at both ends in the cylinder row, and wherein second control members are provided for the respective two cam elements, each of the second control members is projected to an actuated position at which the second control member is projected, in a state where the cam element is separated from the adjacent cam element, to engage with the second end face cam so as to move the cam element to be close to the adjacent cam element, and each of the second control members is retreated to a non-actuated position at which the second control member is retreated from the actuated position.

* * * * *